US006846164B2

(12) United States Patent
Harako et al.

(10) Patent No.: US 6,846,164 B2
(45) Date of Patent: Jan. 25, 2005

(54) MULTI-CYLINDER COMPRESSOR HAVING PLURAL INTAKE PORTS IN A BEARING PLATE AND A COVER MEMBER FORMING A SEALED SPACE OVER THE BEARING PLATE

(75) Inventors: Takashi Harako, Osaka-fu (JP); Hiroshi Nishikawa, Osaka (JP); Takahiro Nishikawa, Osaka (JP); Tetsuya Kato, Osaka (JP); Eiji Fukuda, Osaka (JP); Takayuki Mizuno, Osaka (JP); Kazuya Sato, Osaka (JP)

(73) Assignee: Sanyo Electric Co., Ltd., Osaka-Fu (JP)

( * ) Notice: Subject to any disclaimer, the term of this patent is extended or adjusted under 35 U.S.C. 154(b) by 0 days.

(21) Appl. No.: 10/113,914

(22) Filed: Mar. 29, 2002

(65) Prior Publication Data

US 2002/0155006 A1 Oct. 24, 2002

(30) Foreign Application Priority Data

Mar. 30, 2001 (JP) ..... 2001-102225

(51) Int. Cl.[7] ..... F04B 25/04

(52) U.S. Cl. ..... 417/254; 417/262; 417/273; 417/441

(58) Field of Search ..... 417/254, 255, 417/259, 262, 273, 441, 521, 523

(56) References Cited

U.S. PATENT DOCUMENTS

| | | | | |
|---|---|---|---|---|
| 5,033,940 A | * | 7/1991 | Baumann | 417/273 |
| 5,382,140 A | * | 1/1995 | Eisenbacher et al. | 417/273 |
| 6,213,729 B1 | * | 4/2001 | Fassbender et al. | 417/273 |
| 6,431,840 B1 | * | 8/2002 | Mashimo et al. | 417/244 |

FOREIGN PATENT DOCUMENTS

JP 406058244 A * 1/1994

* cited by examiner

*Primary Examiner*—Justine R. Yu
*Assistant Examiner*—Emmanuel Sayoc
(74) *Attorney, Agent, or Firm*—Weingarten, Schurgin, Gagnebin & Lebovici LLP

(57) ABSTRACT

The purpose of the present invention is to provide a multi-cylinder compressor permitting to increase a gas inflow into the housing without enlarging the intake ports of the bearing plate. The bearing plate 12 bearing the crankshaft 9 is provided with plural intake ports 12*a* at regular intervals in the circumferential direction. The substantially inversely-dished cover member 14 is mounted on the top of the bearing plate 12, and it not only covers the plural intake ports 12*a*, but also forms a sealed space S between the cover member and the bearing plate 12, and is further provided with an introducing opening 14*a* larger than the intake port 12*a* at the center top of the cover member 14. The introducing opening 14*a* is fitted with the gas supply pipe 15 to be connected to the gas supply source (not illustrated).

4 Claims, 4 Drawing Sheets

MULTI-CYLINDER COMPRESSOR HAVING PLURAL INTAKE PORTS IN A BEARING PLATE AND A COVER MEMBER FORMING A SEALED SPACE OVER THE BEARING PLATE

BACKGROUND OF THE INVENTION

1. Field of the Invention

The present invention relates to a multi-cylinder compressor provided with plural gas compression parts, and especially to the one enabled to increase an intake gas quantity.

2. Detailed Description of the Prior Art

Conventionally, a multi-cylinder compressor, which is arranged so as to discharge a high-pressure gas by compressing an intake gas through plural gas compression parts, has been known. For example, as shown in FIG. 7, a 4-cylinder compressor has been known, wherein four gas compression parts A, B, C, D are arranged crosswise and opposite to each other. In the 4-cylinder compressor, the intake gas is compressed by the 1st gas compression part A and sent to the next gas compression part B, and the gas is compressed by the gas compression part B and then is sent to the next gas compression part C, and further compressed by the gas compression part C before it is sent to the next gas compression part D, and finally compressed by the gas compression part D and discharged. Namely, the intake gas is sequentially compressed by the gas compression parts A through D, and is discharged as a high-pressure gas.

In this case, in order to discharge a gas at 30 MPa as a final high pressure, normally, a gas of 0–0.05 MPa is raised step by step by each gas compression part A–D with a compression ratio of 3–5. The later the stage is, the smaller cylinder diameter of the gas compression parts A–D have, and this is called a 4-cylinder 4-stage compressor. However, it has been found out from experiments that if the 1st intake gas is pressurized up to 0.5 Mpa, the 1st stage gas compression part A is not necessary, namely, the final gas pressure of 30 Mpa can be obtained experimentally from a 3-cylinder 3-stage compressor consisting of the 2nd gas compression part B, the 3rd gas compression part C, and the 4th gas compression part D.

The 3-cylinder 3-stage compressor is arranged just like the 4-cylinder 4-stage compressor as shown in FIG. 8 so that a gas is sucked from the intake port H arranged on the bearing plate G located on the top of a housing F of the compressor main body, and the gas is sucked into the 2nd stage gas compression part B for compression thereof.

SUMMARY OF THE INVENTION

When the 1st gas pressure to be supplied into the intake port H from a gas supply source (the figure omitted) is raised to 0.5 Mpa in the above-mentioned 3-cylinder 3-stage compressor, a gas inflow from the intake port H has tended to decrease. In order to increase the gas inflow, for example, the intake port H had better be increased in the diameter. However, since the bearing plate G bears the crankshaft I of a driving device via the bearing J as shown in FIG. 8 (*b*), the diameter of the inlet port H cannot be enlarged because the bearing J obstructs to increase it.

The purpose of the present invention is to solve such a conventional problem, and to provide a multi-cylinder compressor arranged so as to be increased in the gas inflow without enlarging the diameter of the gas intake port H of the bearing plate G.

As a means for achieving the above-mentioned purpose, the argument of the present invention is that the bearing plate is provided with plural intake ports in the multi-cylinder compressor wherein it is provided with plural gas compression parts comprising pistons and cylinders, and wherein the crankshafts for actuating the pistons of each gas compression part are born on the bearing plate arranged on the top of the housing, and wherein the bearing plate is provided with intake ports.

Moreover, the multi-cylinder compressor is characterized in that a cover member provided with an introducing port is mounted on the top of the bearing plate, and the cover member covers the plural intake ports and also forms a sealed space across the bearing plate.

The multi-cylinder compressor is further characterized in that the plural gas compression parts are of a multi-stage compression system or of a single stage compression system.

Since the bearing plate is provided with plural intake ports in accordance with the present invention, it is possible to increase a gas inflow without enlarging the diameter of the conventional intake port. Moreover, it is possible to make the gas introduced from the introducing port flow into plural intake ports by mounting the cover member provided with the introducing port on the top of the bearing plate, and the arrangement also facilitates pipe connection to a gas supply source.

DETAILED DESCRIPTION OF THE PREFERRED EMBODIMENT

Figure 1:
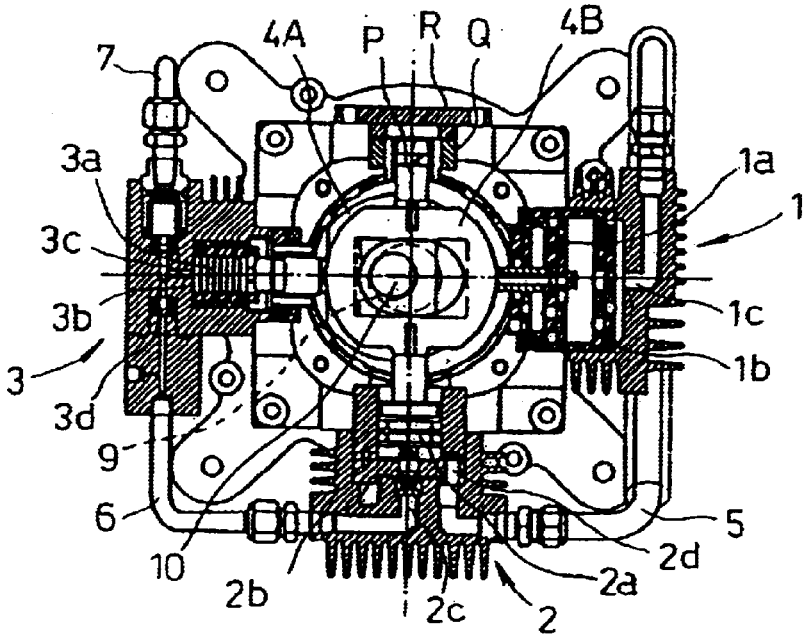
FIG. 1. A schematic drawing of a cross section showing an embodiment of the present invention applied to a 3-cylinder 3-stage compressor.

Next, the embodiments of the multi-cylinder compressor in accordance with the present invention will be explained on the basis of the attached drawings. FIG. 1 shows a 3-cylinder 3-stage compressor, and the 1st stage gas compression part 1, the 2nd stage gas compression part 2, and the 3rd stage gas compression part 3 are arranged in a T-shape opposite to each other.

The 1st stage gas compression part 1 has a piston 1*a* and a cylinder 1*b*, and the piston 1*a* is coaxially coupled with the piston 3*a* of the 3rd stage gas compression part 3 opposed to the piston 1*a* via a yoke 4A, and the cylinder 1*b* is provided with a discharge opening 1*c*.

The 2nd stage gas compression part 2 has a piston 2*a* and a cylinder 2*b*, and the piston 2*a* is coaxially coupled with a piston P for stabilization opposed to the piston 2*a* via a yoke 4B shifted out of phase with the yoke 4A by 90 degrees, and the head part of the cylinder 2*b* is provided with a discharge opening 2*c* and an intake port 2*d*. The intake port 2*d* of the 2nd stage gas compression part 2 is connected with the discharge opening 1*c* of the 1st stage gas compression part 1 through a 1st communication pipe 5. Moreover, although the piston P for stabilization is located in a cylinder Q, the part is not provided with a compression part but blocked with a cap R.

The 3rd stage gas compression part 3 has a piston 3*a* and a cylinder 3*b*, and the piston 3*a* is attached to the yoke 4A, and the head part of the cylinder 3*b* is provided with a discharge opening 3*c* and an intake port 3*d*. The intake port 3*d* of the 3rd stage gas compression part 3 is connected with the discharge opening 2*c* of the 2nd stage gas compression part 2 through a 2nd communication pipe 6, and a discharge pipe 7 is fitted to the discharge opening 3*c* of the 3rd stage gas compression part 3. The 1st stage gas compression parts 1 to 3 correspond to the 2nd stage gas compression part to the 4th stage gas compression part in a conventional 4-stage compressor, respectively.

Figure 2:
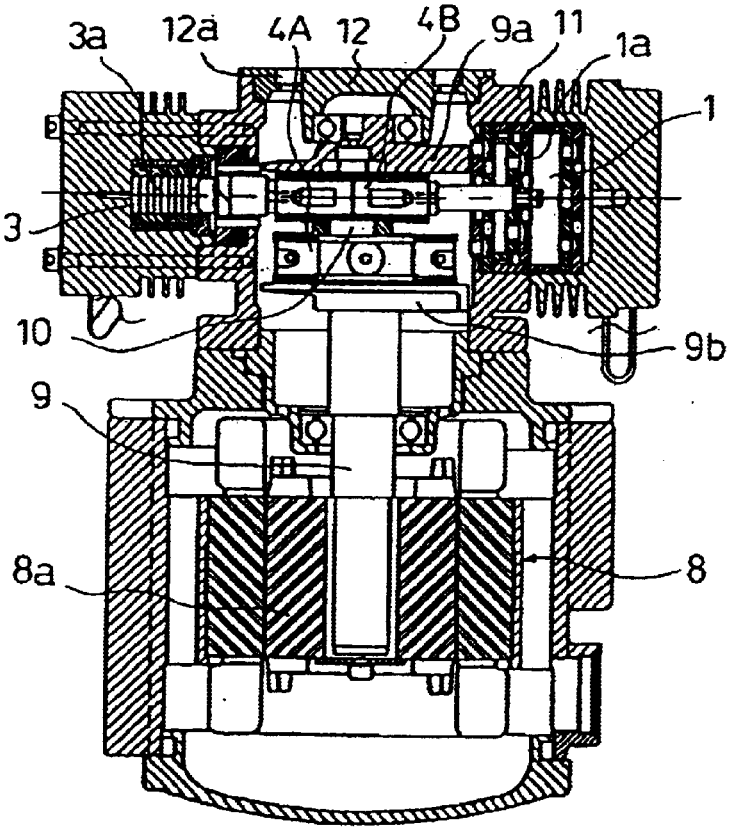
FIG. 2. A schematic drawing of a longitudinal section showing the same embodiment as in FIG. 1.

Under these gas compression parts, an electric driving part is arranged as shown in FIG. 2, and an electric motor 8 is installed in the electric driving part so that the rotor 8*a* rotates, and a crankshaft 9 is coupled with the rotor 8*a*. A crank pin 10 is fitted on the top of the crankshaft 9 off-centered therefrom, and is also engaged with the yokes 4A, 4B. Moreover, an upper side balancer 9*a* and a lower side balancer 9*b* are mounted on the crankshaft 9, and appropriate balance weights (a figure omitted) are fixed on these balancers so as to maintain favorable rotation of the crankshaft 9.

Figure 3:
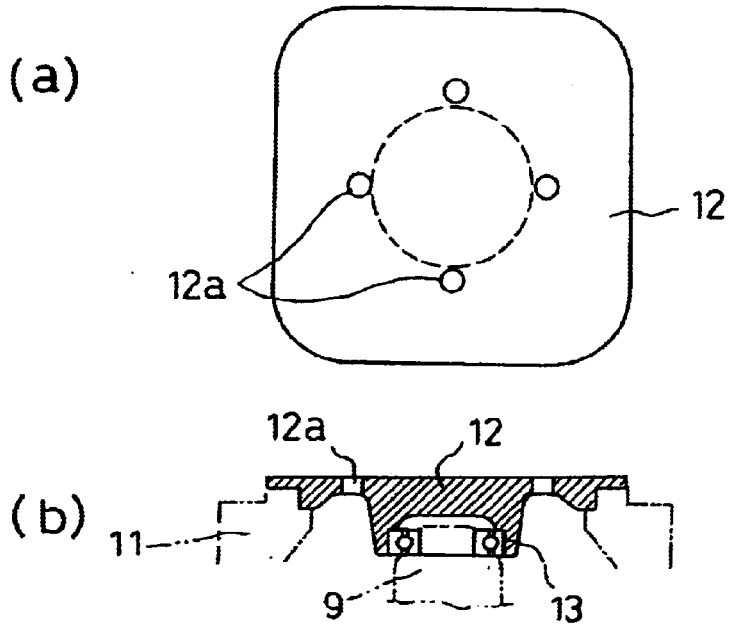
FIG. 3. The drawing shows a state of intake ports; (a) illustrates a top view of the bearing plate, and (b) illustrates a schematic drawing of a longitudinal section.

The top end part of the crankshaft 9 is born on the bearing plate 12 mounted on the top of the housing 11 via the bearing 13 as shown in FIG. 3 (*b*), and as shown in FIG. 3 (*a*), the bearing plate 12 is provided with plural (four) intake ports 12*a* at regular intervals in the circumferential direction.

Figure 4:
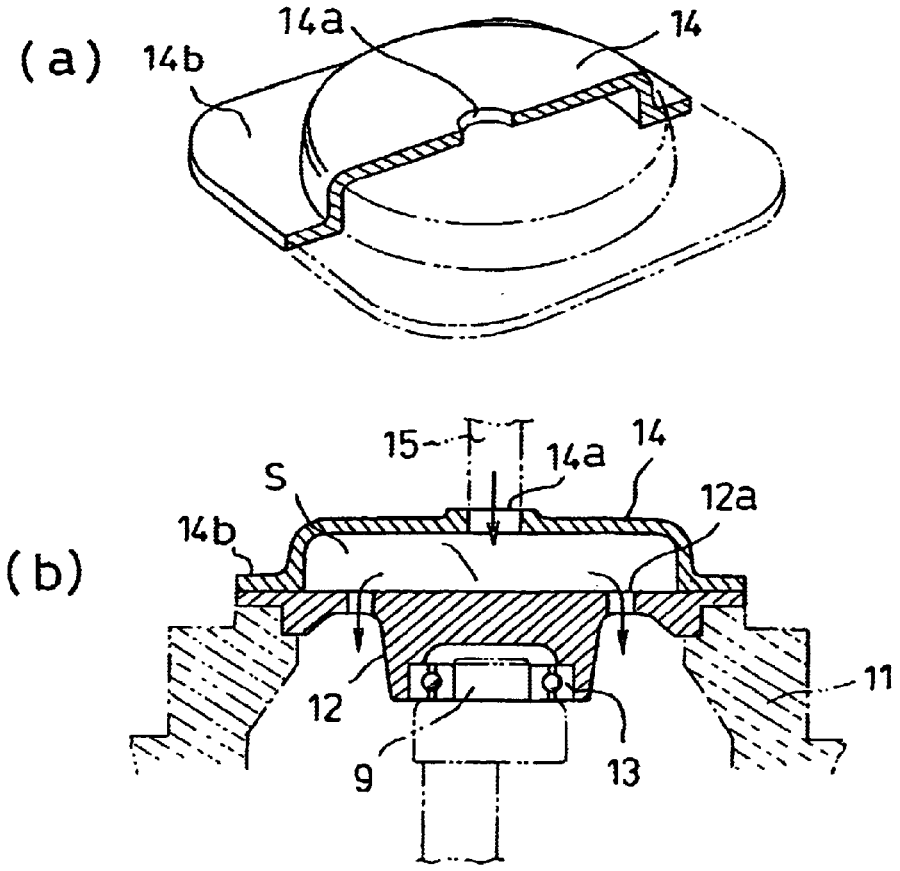
FIG. 4. The drawing shows another state of intake ports; (a) illustrates a semi-cross section perspective view of the cover member, and (b) illustrates a drawing of a longitudinal cross section in the state in which the cover member is mounted on the bearing plate.

FIG. 4 illustrates another embodiment in accordance with the present invention, and as shown in (b), an inversely-dished cover member 14 is mounted on the top of the bearing plate 12 with the lower end square flange part 14*b* of the cover member 14 fixed to the bearing plate 12, and the cover member 14 not only covers the plural intake ports 12*a*, but also forms a sealed space S between the bearing plate 12 and the cover member 14, and further, as shown in (a), an introducing opening 14*a* larger than the intake ports 12*a* (the diameter is 25–30 mm) is arranged at the center on the top of the cover member 14.

The 3-stage 3-cylinder compressor in accordance with the present invention is constructed as described above, and it is possible to boost the pressure of the gas by compressing it using the gas compression parts sequentially from the 1st stage 1 to the final 3rd stage 3, and discharge a high pressure gas at 30 MPa from the discharge pipe 7. In that case, a 0.5 MPa gas is firstly supplied into the housing 11 through the plural intake ports 12*a* of the bearing plate 12. Thanks to the four pieces of intake ports 12*a*, the gas is not only decreased in intake pressure loss but increased in an intake gas quantity, and further decreased in pulsation.

Figure 6:
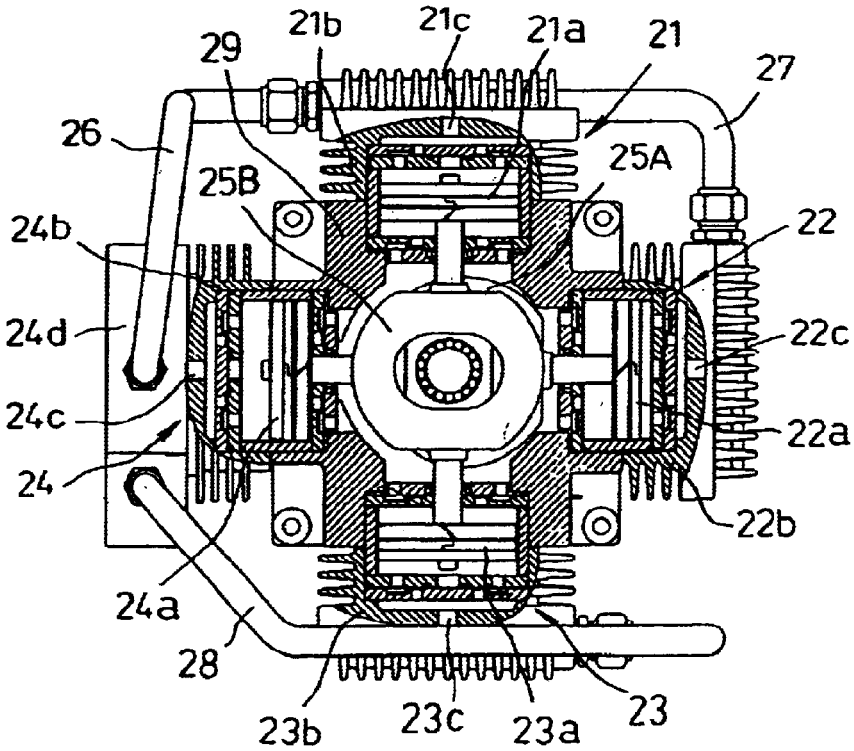
FIG. 6. A schematic drawing of a cross section showing the same embodiment as in FIG. 5.
Figure 7:
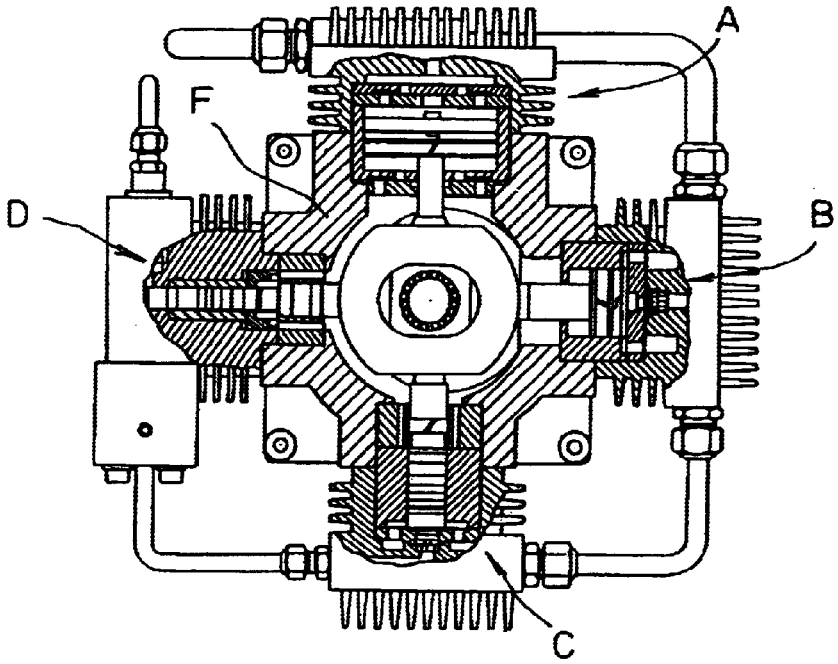
Fig. 7 PRIOR ART
FIG. 7. A schematic drawing of a cross section of a conventional 4-cylinder 4-stage compressor.
Figure 8:
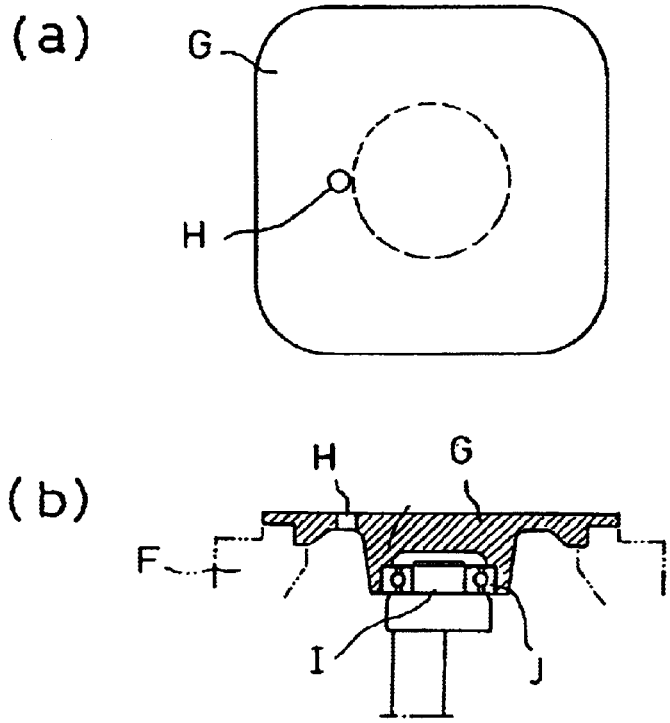
Fig. 8 PRIOR ART
FIG. 8. The drawing illustrates a state of a conventional intake port; (a) illustrates a top view of the bearing plate, and (b) illustrates a schematic longitudinal cross section.

Due to the four pieces of intake ports 12*a*, four pieces of gas supply pipes (a figure omitted) to be connected with each intake port 12*a* from a gas supply source (a figure omitted) are necessary, however, in the case of the embodiment shown in FIG. 6, it is advantageous that only a single large gas supply pipe is required to be connected to the introducing port 14*a* of the cover member 14. Moreover, when the cover member 14 is attached, the gas introduced from the introducing opening 14*a* expands in the sealed space S and is muffled. Namely, the cover member 14 has acted as an expansion type muffler, and intake gas noise has been reduced. The muffled gas is made to flow into the housing 11 from the four pieces of intake ports 12*a* of the bearing plate 12. Further, since the cover member 14 reinforces the bearing plate 12, it also acts to increase rigidity of the bearing plate 12.

Incidentally, since the gas supply source supplies a gas originally at 0.5 Mpa, the gas pressure has been reduced to 0–0.05 MPa by arranging a pressure regulator before a conventional 4-stage compressor, however, according to the present invention, it is advantageous that the gas of 0.5 MPa can be supplied directly from the gas supply source, and so the pressure regulator is not necessary.

The gas made to flow into the housing 11 is sucked into the cylinder 1*b* of the 1st stage gas compression part 1, and compressed to 2 MPa and sent into the 2nd stage gas compression part 2 via the 1st communication pipe 5. In the 1st stage gas compression part, the intake port (a figure omitted) to the cylinder 1*b* and the discharge port 1*c* are provided with respective check valves, so that the suction and discharge processes can smoothly be performed. The arrangement is the same with the 2nd stage gas compression part 2 and the 3rd stage gas compression part 3.

The compression gas transferred into the 2nd stage gas compression part 2 is pressurized up to 10 MPa. Further, the compression gas pressurized by the 2nd stage compressor 2 is transferred into the 3rd stage compressor 3 and pressurized up to 30 MPa. The high-pressure gas pressurized by the 3rd stage compressor 3 is discharged from the discharge pipe 7. The high-pressure gas discharged from the discharge pipe 7 is filled into a cylinder or the like. In such a manner, it is possible to obtain the same final high-pressure gas of 30 MPa even from the 3-cylinder 3-stage compressor as that from a conventional 4-cylinder 4-stage compressor.

Each compression process from the 1st stage gas compression part 1 to 3rd stage gas compression part 3 is carried out by means of what is called a Scotch yoke mechanism. Namely, the crank pin 10 rotates around the center shaft of the crankshaft 9 synchronizing with the rotation of the crankshaft 9 driven by the electric motor 8, and rotational motion is converted into reciprocating motion via the yokes 4A, 4B engaged with the crank pin 10, and thereby each piston is operated. The yokes 4A, 4B are made to be out of phase with each other by 90 degrees as described above, therefore, the compression processes by each gas compression part are shifted in time, and it is possible to compress the gas by sequentially timing from the 1st stage gas compression part 1 to the 3rd stage gas compression part 3. Moreover, since the compression process of the 2nd stage gas compression part 2 is provided with the stabilizing pin P and cylinder Q on the opposite side as described above, the arrangement prevents vibration and rattling, to permit stable gas compression.

Figure 5:
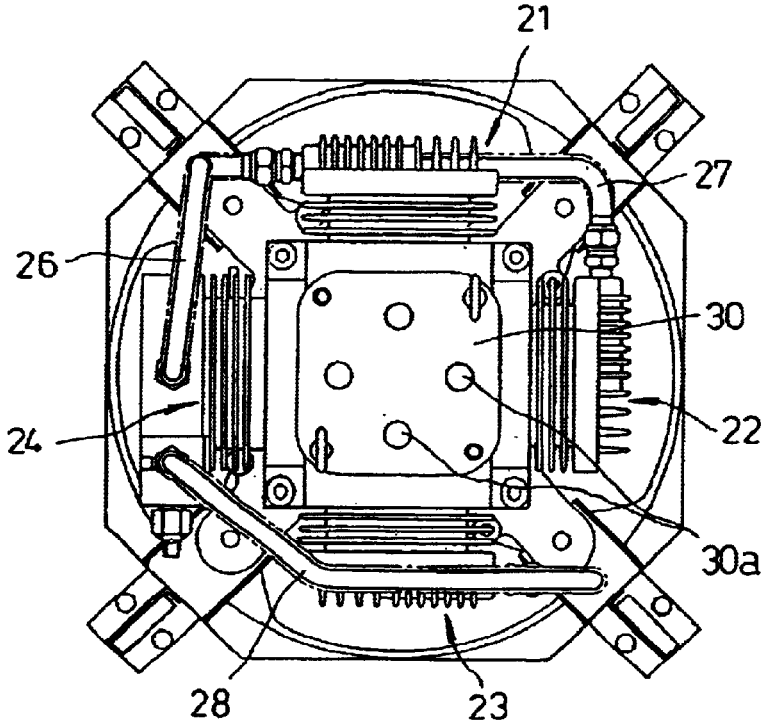
FIG. 5. A top view drawing showing an embodiment of the present invention applied to a 4-cylinder single stage compressor.

FIG. 5 illustrates an embodiment wherein the present invention is applied to a 4-cylinder single stage compressor, in which a 1st gas compression part 21, a 2nd gas compression part 22, a 3rd gas compression part 23, and a 4th gas compression part 24 are arranged crosswise and opposite to each other.

The 1st gas compression part 21 has a piston 21*a* and a cylinder 21*b*, and the piston 21*a* is coaxially connected with the piston 23*a* of the 3rd gas compression part 23 opposed thereto via the yoke 25A, and the cylinder 21*b* is provided with a discharge opening 21*c* on the head part.

The 2nd gas compression part 22 has a piston 22*a* and a cylinder 22*b*, and the piston 22*a* is coaxially connected with the piston 24*a* of the 4th gas compression part 24 opposed thereto via the yoke 25B shifted out of phase with the yoke 25A by 90 degrees, and the cylinder 22*b* is provided with a discharge opening 22*c* on the head part.

The 3rd gas compression part 23 has a piston 23*a* and a cylinder 23*b*, and the piston 23*a* is attached to the yoke 25A, and the cylinder 23*b* is provided with a discharge opening 23*c* on the head part.

The 1st gas compression part 21 is connected with the 4th gas compression part 24 via a 1st gas transfer pipe 26, and the 1st gas transfer pipe 26 communicates not only with the discharge opening 21*c* of the 1st gas compression part 21 but also with the path (a figure omitted) in the head part 24*c* of the 4th gas compression part 24. Thus, the gas compressed by the 1st gas compression part 21 is transferred into the head part 24*d* of the 4th gas compression part 24 through the 1st gas transfer pipe 26.

Similarly to the above, the 2nd gas compression part 22 is connected with the 4th gas compression part 24 through the 2nd gas transfer pipe 27, and the 3rd gas compression part 23 is connected with the 4th gas compression part 24 through the 3rd gas transfer pipe 28, and thus the gas compressed by the 2nd gas compression part 22 and the gas compressed by the 3rd gas compression part 23 are transferred into the cylinder head part 24*d* of the 4th gas compression part 24 via the 2nd gas transfer pipe 27 and the 3rd gas transfer pipe 28, respectively.

Similarly to the previous embodiment, the bearing plate 30 mounted on the top of the housing 29 is provided with plural intake ports 30*a* at regular intervals in the circumferential direction as shown in FIG. 5. In this case, four pieces of intake ports 30*a* are arranged at the positions corresponding to the 1st gas compression part 21 to 4th gas compression part 24, however, the number or the positions of the intake ports 30*a* are not restricted to those shown in the figure. Moreover, although an illustration is omitted here, it is preferable to mount the cover member 14 on the bearing plate 30 in order to facilitate the connection with the gas supply source.

Although the 4-cylinder single stage compressor of the structure has the same driving system as the 3-cylinder 3-stage compressor, the former differs from the latter in the point that it has the single stage compression system. Namely, the gas made to flow into the housing 29 from the intake ports 30*a* is sucked into the 1st gas compression part 21—the 4th gas compression part 24 and compressed, respectively, and each compression gas is all transferred and joined into the head part 24*d* of the 4th gas compression part 24, and discharged from the head part 24*d*.

Since the yokes 25A, 25B of the Scotch yoke mechanism are out of phase by 90 degrees as described above, the compression processes with the 1st gas compression part 21—the 4th gas compression part 24 are not performed at the same time, but are sequentially performed from the 1st gas compression part 21 to the 4th gas compression part 24. The compressed gas from the 1st gas compression part 21—the 3rd gas compression part which have already finished the compression processes is transferred into the head part 24*d* of the 4th gas compression part 24 via the 1st gas transfer pipe 26—the 3rd gas transfer pipe 28 before the compression by the 4th gas compression part 24.

Then, the gas compressed in the process of compression by the 4th gas compression part 24 and the gas, which has already been transferred therein, are joined in the head part 24*d* and discharged.

Since the bearing plate 30 is provided with plural intake ports 30*a* as described above, a pressure loss is reduced at sucking and a suction gas quantity is increased, and further a ripple is reduced. Consequently, each of the gas compression parts 21–24 can suck a sufficient quantity of gas and can efficiently compress it. Moreover, since each of the gas compression parts 21–24 has the same diameter in this case, it is possible to discharge a large amount of a stable gas compressed at the same compression ratio.

As explained above, according to the present invention, it is possible to increase a gas inflow without enlarging a diameter of an intake port by providing the bearing plate with plural gas intake ports in the multi-cylinder compressor. Moreover, the present invention has such excellent advantages as it is possible to connect the compressor with the gas supply source via a single connection pipe by mounting a cover member with an introducing opening on the bearing plate; the cover member acts as an expansion type muffler for muffling the influent gas and further increases the rigidity of the bearing plate; etc.

What is claimed is:

1. A multi-cylinder compressor, comprising:

a plurality of gas compression parts comprising pistons and cylinders, wherein said plurality of gas compression parts are of a multi-stage compression;

a crank shaft for driving the piston of each gas compression part born by a bearing plate arranged on the top of a housing; and said bearing plate provided with an intake port, characterized in that said bearing plate is provided with a plurality of intake ports;

wherein a cover member provided with an introducing opening is mounted on the top of said bearing plate, the plural intake ports are covered with said cover member, and a sealed space is formed between the cover member and the bearing plate.

2. A multi-cylinder compressor comprising:

a plurality of gas compression parts comprising pistons and cylinders, wherein said plurality of gas compression parts are of a multi-stage compression;

a crank shaft for driving the piston of each gas compression part born by a bearing plate arranged on top of a housing;

said bearing plate provided with an intake port, characterized in that said bearing plate is provided with a plurality of intake ports, and wherein a cover member provided with an introducing opening is mounted on the top of said bearing plate, and said introducing opening is larger than said intake ports.

3. A multi-cylinder compressor comprising:

a plurality of gas compression parts comprising pistons and cylinders;

a crank shaft for driving the piston of each gas compression part born by a bearing plate arranged on the top of a housing; and said bearing plate provided with an intake port, characterized in that said bearing plate is provided with a plurality of intake ports thereby to restore a gas flow rate;

wherein a cover member provided with an introducing opening is mounted on the top of said bearing plate, the plural intake ports are covered with said cover member, and a sealed space is formed between the cover member and bearing plate;

wherein the plural gas compression parts are of a multi-stage compression system.

4. A multi-cylinder compressor as comprising:

a plurality of gas compression parts comprising pistons and cylinders;

a crank shaft for driving the piston of each gas compression part born by a bearing plate arranged on top of a housing;

said bearing plate provided with an intake port, characterized in that said bearing plate is provided with a plurality of intake ports thereby to restore gas flow rate, and wherein a cover member provided with an suction port is mounted on the top of said bearing plate, and said introducing opening is larger than said intake ports;

wherein the plural gas compression parts are of a single stage compression system.

* * * * *

UNITED STATES PATENT AND TRADEMARK OFFICE

CERTIFICATE OF CORRECTION

PATENT NO. : 6,846,164 B2
DATED : January 25, 2005
INVENTOR(S) : Takashi Harako et al.

It is certified that error appears in the above-identified patent and that said Letters Patent is hereby corrected as shown below:

Column 7,
Line 12, delete “as”;

Column 8,
Line 8, “an” should be -- a --; and
Line 10, “introducing opening” should be -- suction port --.

Signed and Sealed this

Twenty-seventh Day of December, 2005

JON W. DUDAS
*Director of the United States Patent and Trademark Office*